US005320341A

United States Patent [19]

Pease et al.

[11] Patent Number: 5,320,341

[45] Date of Patent: Jun. 14, 1994

[54] DOCUMENT HANDLER FOR TRANSPORTING LARGE DOCUMENTS

[75] Inventors: Donald L. Pease, Honeoye; Michael J. Tracy, Hilton, both of N.Y.

[73] Assignee: Xerox Corporation, Stamford, Conn.

[21] Appl. No.: 155,601

[22] Filed: Nov. 19, 1993

Related U.S. Application Data

[63] Continuation of Ser. No. 905,610, Jun. 29, 1992, abandoned.

[51] Int. Cl.[5] ..... B65H 5/02

[52] U.S. Cl. ..... 271/277; 271/274; 271/204; 271/270; 271/202

[58] Field of Search ..... 271/277, 273, 274, 265, 271/204, 203, 270, 202; 355/75, 309, 230

[56] References Cited

U.S. PATENT DOCUMENTS

| | | | |
|---|---|---|---|
| 3,179,404 | 4/1965 | Felts et al. | 271/57 |
| 3,266,796 | 8/1966 | Haney et al. | 271/45 |
| 3,345,065 | 10/1967 | Shearer et al. | 271/79 |
| 3,689,143 | 9/1972 | Case et al. | 355/3 |
| 3,924,849 | 12/1975 | Murakami | 271/204 |
| 4,269,409 | 5/1981 | Simonek et al. | 271/277 |
| 4,469,319 | 9/1984 | Robb et al. | 271/171 |
| 4,713,674 | 12/1987 | Glezeman et al. | 355/14 |
| 4,986,526 | 1/1991 | Dastin | 271/227 |
| 4,996,556 | 2/1991 | Gray, Jr. | 355/50 |
| 5,056,775 | 10/1991 | Kida | 271/265 |
| 5,128,726 | 7/1992 | Cassano et al. | 271/204 |

OTHER PUBLICATIONS

Research Disclosure Journal, Disclosure No. 16063, Aug. 1977, p. 54.

*Primary Examiner*—David H. Bollinger

[57] ABSTRACT

A document transport system for transporting and selectively recirculating relatively large documents through a processing station. In accordance with this invention, a transport is provided which has a defined endless document path. A gripper bar is provided for selectively and releasably securing the leading edge of large documents, and a driven chain is also provided for supporting and moving the gripper bar at a predetermined imaging speed through an imaging station. Further, drive rollers are provided proximate the imaging station to urge documents in the document path through the imaging station at the predetermined imaging speed. The invention also includes control apparatus for halting the gripper bar at a first position downstream from the processing station to enable release of documents from the gripper bar and at a second position upstream from the processing station to enable selective insertion and retention of documents in the gripper bar. Finally, the chain also recirculates the gripper bar from the first position to the second position at a rate substantially faster than the imaging speed to enable rapid recirculation of documents for imaging and rapid insertion of a new document for imaging after release of a previously imaged document.

9 Claims, 4 Drawing Sheets

DOCUMENT HANDLER FOR TRANSPORTING LARGE DOCUMENTS

This is a continuation of application Ser. No. 07/905,610, filed Jun. 29, 1992, now abandoned.

FIELD OF THE INVENTION

The present invention relates to sheet-like material handlers, generally, and, in particular, large document handlers for transporting large documents to and from an image processing station of a graphic machine.

BACKGROUND OF THE INVENTION

Sheet handling systems for transporting large sheet-like material between processing stations are well known, as are the class of sheet handling systems referred to as document handlers. For example, U.S. Pat. No. 4,996,556 to Gerald A. Grey, Jr. and assigned to Xerox Corporation discloses a system for receiving large documents, individually, which are then fed into a sheet or document feeder. The document is then transported by the feeder to and through an imaging position to image the document on a photoreceptive surface. The process is repeated until the desired number of images are completed by reverse transport of the document back to the initial imaging position and then recommencement of imaging.

Generally, large document handlers used with devices, such as electrophotographic printing machines, use a preselected path through which documents are moved relative to a process station. In electrophotographic printing machines, one of the processing stations generally employed is an imaging station, which can be, for example, an illuminated imaging slit and lens arrangement for reflecting light from the document onto a charged photoconductive surface to form a latent image.

Mishandling or misfeeding of large documents in the document handler can cause wrinkling, buckling, tearing, or other sheet damage to documents being transported through an imaging station. Such mishandling of the fed documents can also cause the image printed to be skewed, uneven, unevenly magnified, or misregistered due to the failure to present the document properly. Thus, the loading, starting positions, speed (sheet velocity) and direction of movement of the large documents can be quite critical to commercially acceptable imaging, as well as saving the original documents handled.

The following disclosures may be relevant to various aspects of the present invention:

U.S. Pat. No. 3,179,404
Patentee: Felts et al.
Issued: Apr. 20, 1965
U.S. Pat. No. 4,269,409
Patentee: Simonek et al.
Issued: May 26, 1981

Research Disclosure Journal

Disclosure No. 16063
August 1977, p. 54
U.S. Pat. No. 4,713,674
Patentee: Giezeman et al.
Issued: Dec. 15, 1987
U.S. Pat. No. 4,986,526
Patentee: Dastin
Issued: Jan. 22, 1981

U.S. Pat. No. 3,266,796
Patentee: Haney et al.
Issued: Aug. 16, 1966
U.S. Pat. No. 3,689,143
Patentee: Case et al.
Issued: Sep. 5, 1972
U.S. Pat. No. 3,345,065
Patentee: Shearer et al.
Issued: Oct. 3, 1967
U.S. Pat. No. 4,996,556
Patentee: Gray, Jr.
Issued: Feb. 26, 1991

The relevant portions of the foregoing disclosures may be briefly summarized as follows:

U.S. Pat. No. 3,179,404 discloses a document transporting apparatus having a gripper which secures documents for travel along a path between a document insertion area and a document tray. A document reading station is provided to scan documents. The gripper is coupled to two belts mounted on drive wheels for movement along the path.

U.S. Pat. No. 4,269,409 discloses a transport mechanism for cyclically conveying a document past an optical scanner in an electrophotographic machine. The transport is provided by a gripper unit for engaging the lead document edge during a cycle through the scanner. The patent also discloses the employment of transport rollers downstream of the optical scanner for fast cycling of the original back to the transport rollers. The transport rollers are mechanically actuated from an inactive to active position after the passage of the gripper unit and an air suction is generated to hold the transported document against an imaging station.

*Research Disclosure Journal*, Disclosure No. 16063, August 1977, p. 54 discloses a scanning station transport having roller sets disposed on opposing sides of the scanning or exposure station. The upper rollers are mounted for movement in a vertical direction to increase the distance between the lower and upper rollers while increase the force exerted on the document. This allows improved transport of a wider variety of documents when a document is in the nip and also by the device.

U.S. Pat. No. 4,713,674 discloses an exposure device having an endless conveyor path for passing a document through an imaging station by successive laps around the path or by successive reversal of conveyance through the station. The patent further discloses the use of detectors to select the appropriate conveyance made of the document to provide efficient imaging of the document. Rollers disposed on opposite sides of the imaging area are employed for the forward and reverse conveyance at the imaging station.

U.S. Pat. No. 4,986,526 discloses a recirculating copy sheet transport which employs a method for calibrating registration of a sheet held by a gripper bar moving on the transport. The sheet is intended to recirculate about the path as various developed monochromatic images are successively transferred to the sheet to provide a registered composite image. The device is provided with sensors to time the movements of the sheet and the sheet gripper as each is moved to an engaging position. The timed movements are compared to a predetermined standard and the relative movements of the gripper and the sheet are adjusted to permit simultaneous arrival of the sheet and the gripper at the loading zone.

U.S. Pat. No. 3,266,796 discloses an apparatus for sheet handling which provides a continuously moving endless track to which a carrier is coupled. The carrier has a clamping element operable to grip and release documents placed therein. The carrier provides conveyance of the document pocket along the path of the endless member. A cam is provided which is movable into the path of the carrier means to disengage the sheet-like material from the gripping member of the carrier which can handle a variety of document sizes.

U.S. Pat. No. 3,689,143 discloses xerographic reproducing machine adapted to create copies of sheet material in several sizes. The machine has a plurality of sensing devices positioned to detect the size of a document to be reproduced as it is moved towards the imaging station. The patent discloses the use of a transport roller which has a gripper fingers to hold the document to be imaged thereto as the transport roller rotates to transport the sheet to pass a sensing area.

U.S. Pat. No. 3,345,065 discloses a sheet transport apparatus having a transport section two transport chains carried by sprockets. The transport chains are preferably roller type sprocket chains. Two grippers are coupled to the chains and are adapted to grasp the edge of a flexible sheet carrying a latent image to be developed. A vacuum platen transport is provided which delivers the edge of the sheet to the grippers for grasping so that a grasped sheet may be transported laterally, with its electrostatic image-bearing surface facing downwardly for contact with the upper portions of a developer housing, and then vertically for other processing.

U.S. Pat. No. 4,996,556 discloses a large document transport for moving documents past an illuminated scanning slit imaging device which exposes a photoreceptive drum. The document is initially transported rapidly past the scanning slit in a first direction through the nips in a first direction for sizing and rapidly back so that imaging may commence. Thereafter, for each multiple copy the process of rapid reverse feeding followed by a forward constant velocity scan feed occurs until a particular document is released upon completion of the desired number of images.

The devices disclosed by these references have provided adequate results to date, nevertheless, many deficiencies and problems continue to exist and, thus, hamper, impede, or otherwise detract from the performance and usefulness of commercial devices. Some of the devices are inefficient, as they do not provide automatic recirculation or require single and even multiple non-scanning transport passes. Some are overly prone to document damage, misfeeds, jams, and the like problems, and some are overly complex or expensive in manufacture and maintenance. A need, therefore, exists for a relatively low cost, simple, large document feeder which has a relatively small endless track and which provides rapid recirculation of a document being imaged without undue risk of document damage while providing ease of loading, constant velocity or speed of the document through the imaging station, and constant directional movement of documents.

SUMMARY OF THE INVENTION

The present invention provides a document transport system for transporting and selectively recirculating relatively large documents through a processing station. In accordance with one aspect of the invention a transport is provided which has means for defining an endless document path. A gripper bar is provided for selectively and releasably securing the leading edge of large documents, and first means for actuating the gripper bar at a predetermined imaging speed is provided so that documents secured by the gripper bar pass through an imaging station at the predetermined imaging speed. Further, means for urging documents in the path proximate the imaging station is also provided for urging documents through the imaging station at the predetermined speed. The invention also includes means for halting the gripper bar at a position upstream from the processing station and at a position downstream from the processing station to enable insertion and release of documents from the gripper bar. Finally, the invention includes second means for actuating the said gripper bar from the second position to the first position at a rate substantially greater than the predetermined speed.

In accordance with another aspect of the present invention, a gripper bar is provided to releasably secure the leading edge of a document. The gripper bar is actuated along a loop path which includes an image input terminal. The gripper bar with document secured therein is actuated along the loop path at an imaging velocity passed the image processing station to a second position. The gripper bar during travel from the first to second portion passes between the nips of two roller pairs provided on opposite sides of imaging area. The rollers of each pair, after the gripper passes between them, engage documents secured to the gripper bar. The drive rollers of each of the roller pairs are driven at the imaging velocity so that the cessation of the travel of the gripper bar at its second position does not effect the velocity of the document at the imaging area. After completion of document imaging, the gripper bar is actuated to return to the first position, having either selectively released or retained the previously imaged document for receiving and imaging a new document or reimaging the retained document. The invention further provides means for actuating the gripper bar at a greater rate in the passage from the second position to the first position than from the first position to the second position.

While the present invention will be described in connection with the preferred embodiment thereof, it will be understood that it is not intended to limit the invention to that embodiment. On the contrary, it is intended to cover all embodiments, modifications, and equivalents as may be included within the spirit and scope of the invention as defined by the appended claims. For a general understanding of the features of the present invention, references should be made to the drawings. In the drawings, like numerals have been used to identify identical elements.

Other features of the present invention will become apparent as the following description proceeds and upon reference to the drawings, in which:

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT OF THE INVENTION

Figure 6:
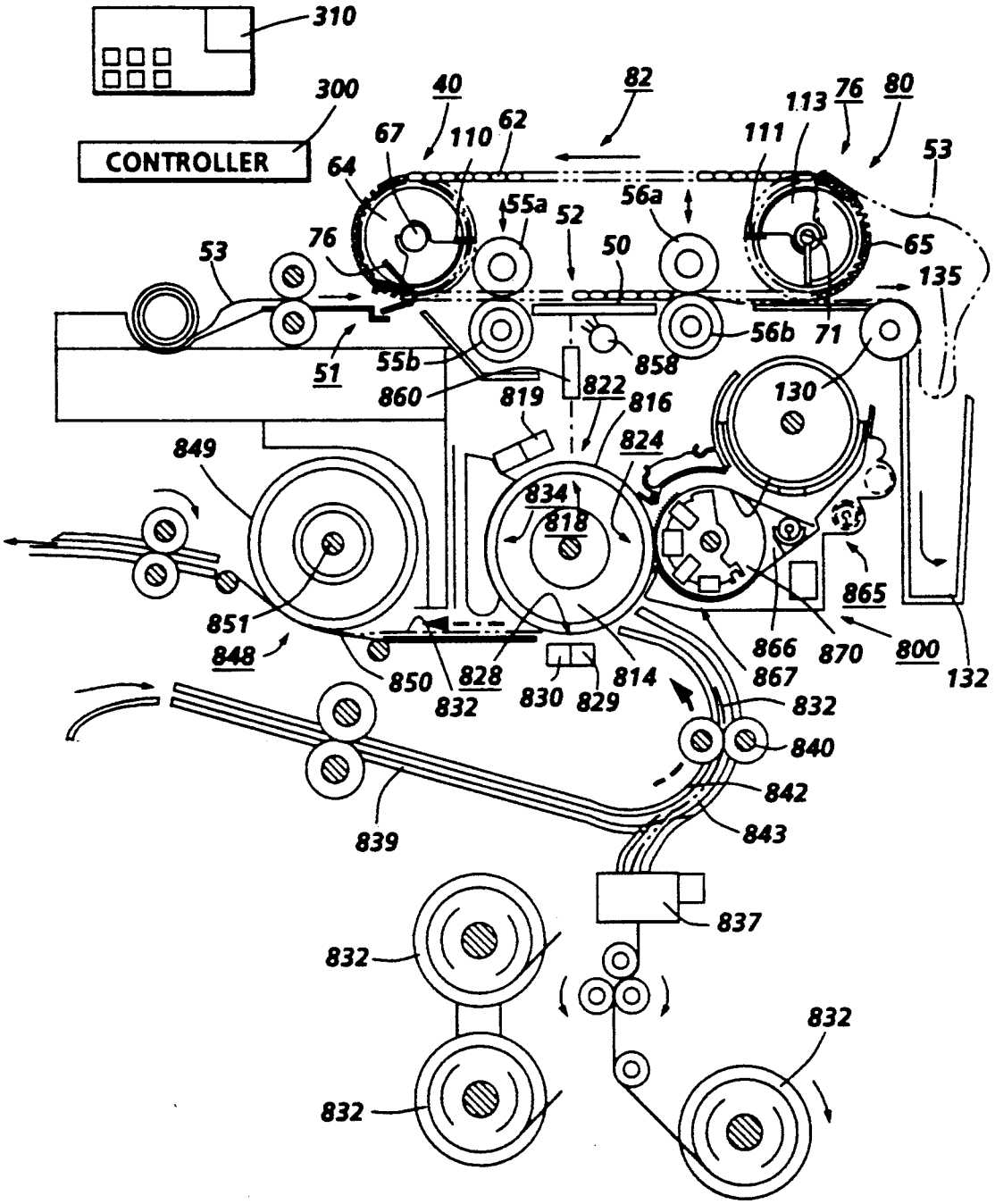
FIG. 6 is a schematic, elevational view of an exemplary electrophotographic device incorporating the FIG. 1 document handling system.

Referring to FIG. 6 of the drawings, there is shown a exemplary electrophotographic printing machine 800 incorporating a document handling system which embodies the present invention. Machine 800 has a suitable cover and frame (not shown for clarity) in and on which the xerographic components and document handling system of the machine are operatively housed and supported. Briefly, as will be familiar to those skilled in the electrophotographic printing and copying arts, the xerographic components of the machine include a charge retentive recording member, shown here in the form of a rotatable photoreceptor drum 814 with a photoconductive surface 816. Other photoreceptor types such as a belt, etc. may be employed, as well as various photoconductive materials such as amorphous selenium, trinitroflourenone or polyvinylcarbazole.

Operatively disposed about the periphery of photoreceptor 814 are a number of electrophotographic process stations: (1) charging station 818 with charging element 819 such as a corona generator for placing a uniform charge on the photoconductive surface 816 of the photoreceptor drum 814; (2) imaging station 822 where light reflected from a document 53 is reflected onto the previously charged portion of photoconductive surface 816 to thereby form a latent electrostatic image on the photoconductive surface 816; (3) developing station 824 where the latent electrostatic image on photoconductive surface 816 is developed by toner; (4) combination transferring and detacking station 828 with transfer corona generator 829 and detack corona generator 830 where the developed image on the photoconductive surface is transferred to a suitable copy substrate material such as copy sheet 832 and the copy sheet and image are separated or detacked from the photoreceptor 814; and (5) cleaning station 834 for removing leftover material on the photoconductive surface 816. The other processing stations of the electrophotographic process are positioned along the path of copy sheet 832.

At the transfer station 828, the copy sheet 832 is brought forward by feed roll pair 840. Sheet guides 842 and 843 serve to guide the sheet to the transfer station 828. The sheet as shown in FIG. 6 has been cut by cutter 837 which cuts the sheets from any of supply rolls 832, which can include vellum, paper, etc. It will also be recognized that sheets can be fed to the transfer station 828 via sheet path 839. Following transfer, the sheet 832 is carried forward to a fusing station 848 where the toner image is fixed to the copy sheet by fusing roll 849 and web 850. The fusing roll 849 is heated by a suitable heater such as quartz lamp 851 disposed within the interior of roll 849. After fusing, the copy sheet 832 is discharged from the machine or to a finishing station (not shown).

Figure 1:
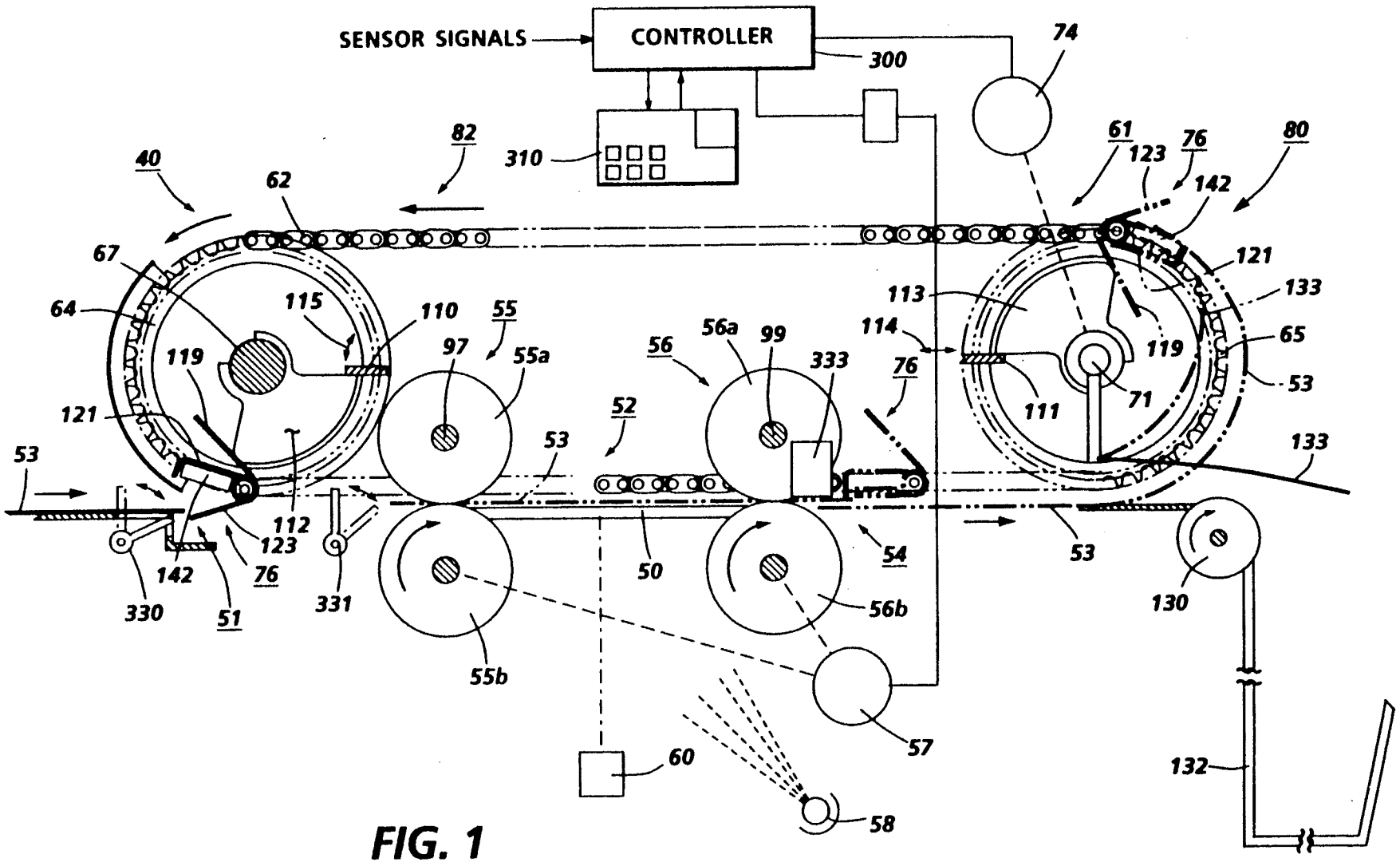
FIG. 1 is a schematic elevational view showing the document handling system of the present invention which is particularly adapted for transporting large documents to and from processing stations.

The present invention will now be discussed in greater detail with particular reference to FIGS. 1–5 which illustrates the preferred embodiment of the invention. As seen in FIG. 1, the transport system 40 of the present invention comprises a continuous track for transporting sheet-like material, to and through an image processing station. A transparent platen 50 supports a document 53 as the document is moved from a document insertion or input area 51, past an image or scan area 52 by a constant velocity type transport 54. As should be understood, scan area 52 is in effect a scan line which extends across the width of platen 50, so that the document is scanned line by line as the document is moved along platen 50 by transport 54. Transport 54 has input and output document feed roll pairs 55, 56, respectively, on each side of scan area 52 for engaging the document 53 between the nips of the rollers and for urging the document 53 across platen 50 at a predetermined speed. Stepper motor 57 is provided to actuate drive rolls **55*b* and 56*b*. In this embodiment, exposure lamp 58 is also provided to illuminate a strip-like area of platen 50 at scan area 52 to permit imaging of documents by an image input device 60**.

The document transport system 54 of the present invention also includes a chain drive system 61 having a chain 62 and another chain (not shown). Chain 62 is mounted on sprockets 64, 65, and the other chain (not shown) is similarly mounted on sprockets (not shown). Sprocket 64 is mounted on idler axle 67, and sprocket 65 is mounted on drive axle 71 as are the other sprockets (not shown). A suitable drive means such as a stepper motor 74 is operably connected to the drive axle 71 so that the rotation of the axle 71 is transmitted to the chains. A document gripper bar 76 is supported between the chain 62 and the other chain (not shown). It will be appreciated that the gripper bar can be replaced by other suitable means such as gripping fingers and the like.

The chains define a document travel path from the document input area 51, through the imaging area 52, to a document release area 80, as well as a document recirculation path 82. It will be understood and appreciated that other means for transporting the gripper bar 76, such as a belt and pulley drive arrangement may be substituted for the chains and sprockets of the present embodiment. As more fully explained below, the gripper bar 76 functions to secure the leading edge of a document at the input area 51; to transport the leading edge of the document from the input area via the imaging area 52 to the selective release area 80 at a constant velocity; to release documents not recirculated at the release area 80; and to return to the input area 51 for either recirculation of an unreleased document or insertion of another document. Thus, the transport system 40 provides means for transporting documents to and through an imaging station by the transport 54 and for selectively releasing or recirculating such documents after passing through the imaging station.

Figures 2, 3:
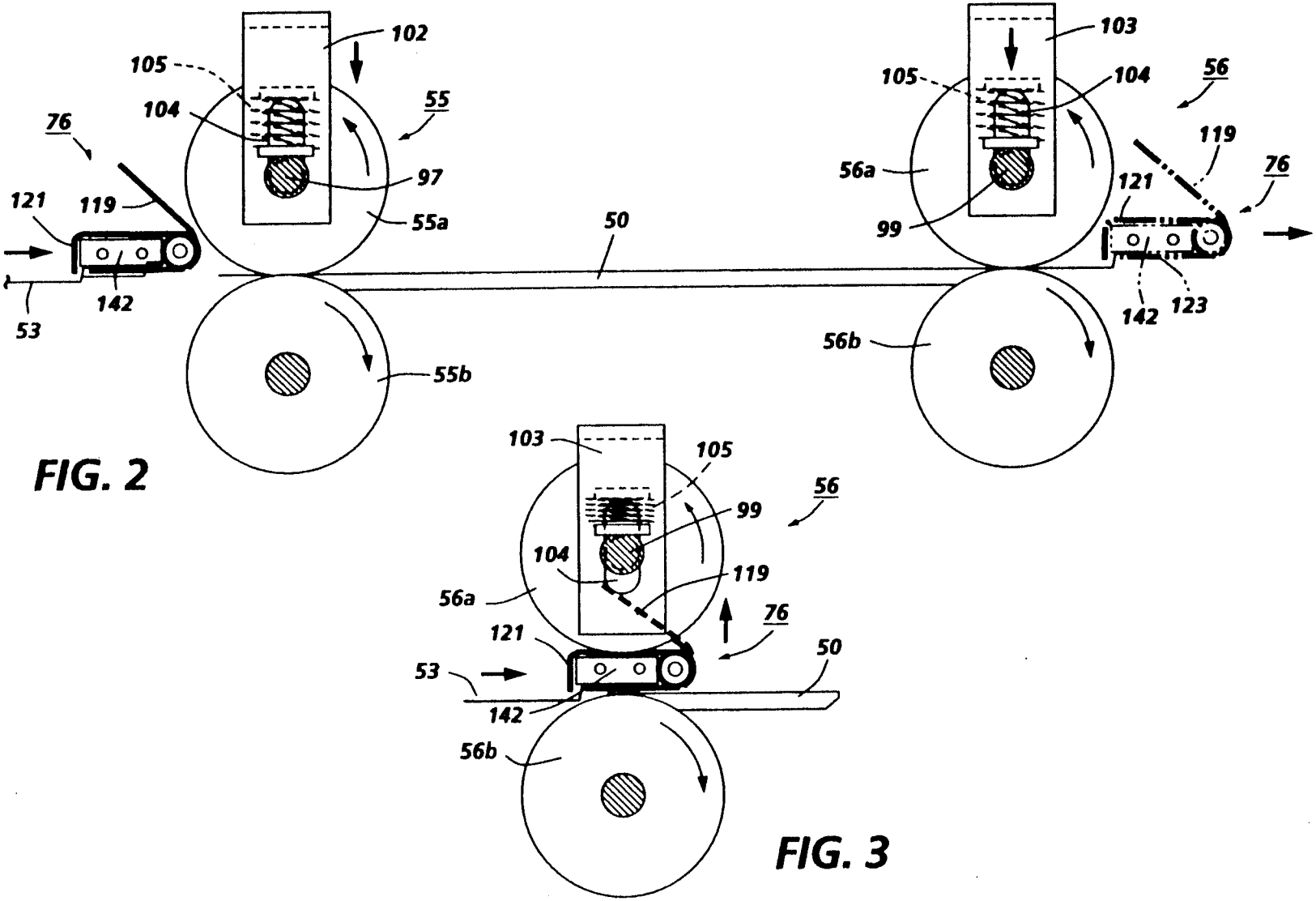
FIG. 2 is an enlarged, schematic elevational view of a portion of the FIG. 1 document handling system.
FIG. 3 is an enlarged, schematic elevational view of one of the roller sets of FIG. 2.

It will also be understood that visual or mechanical guides may be provided for directing documents during presentation of documents to the gripper bar 76 at the input area 51. The transport 54 for urging documents through the imaging area 52 includes drive rollers **55*b* and 56*b* on opposite sides of the imaging area. Idler rollers 55*a* and 56*a* engage drive rollers 55*b* and 56*b*, respectively, with the nip of each roller set 56 and 55 disposed in the document path. The idler rollers 55*a* and 56*a* are mounted on axles 97 and 99** which are mounted for vertical movement (See FIGS. 2 and 3). As demonstrated in FIG. 2, the axles 97 and 99 are mounted in support brackets 102 and 103, respectively. Each of the brackets have a longitudinal slot 104 through which the axles extend. Spring members 105, and, as in this embodiment, gravity urge contact between the idler rollers 55*a* and 56*a* and drive rollers 55*b* and 56*b*. Thus, each pair of rollers 55*a* and 55*b* and 56*a* and 56*b* separate as the elongated gripper bar 76 passes through the nips of the roller sets 55 and 56, as illustrated in FIG. 3, where the gripper bar 76 is shown passing through the nip of roller set 56.

Figure 4:
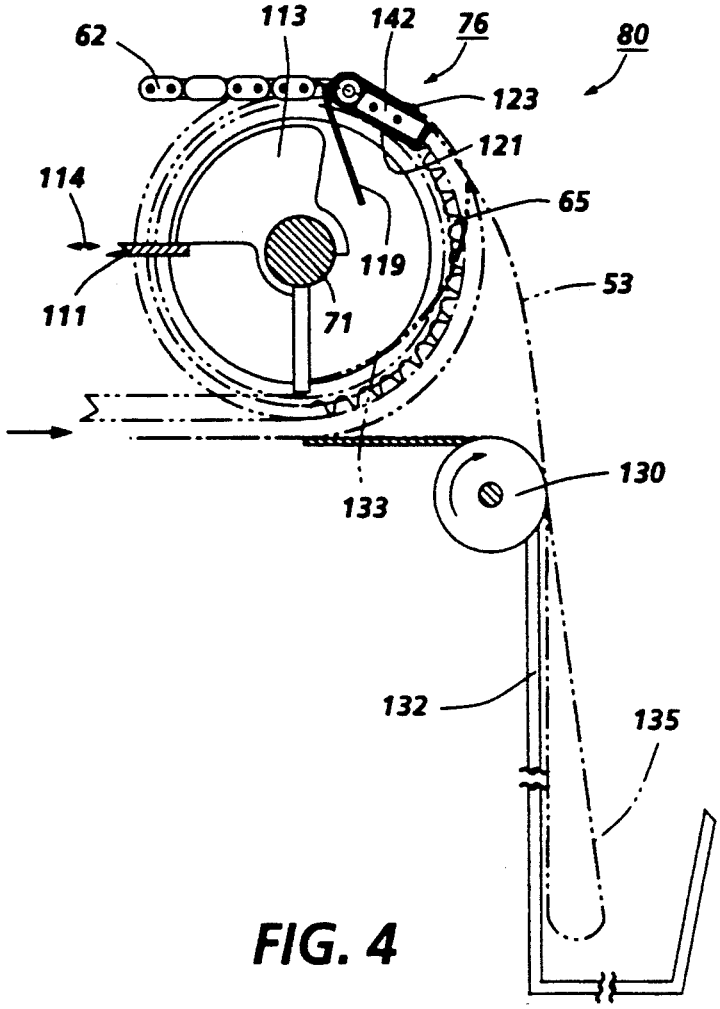
FIG. 4 is an enlarged, elevational view of a portion of the FIG. 1 document handling system.

Referring to FIG. 4, the drive sprocket 65 is shown with the gripper bar 76 positioned on the chain 62 at the document release area 80. The cam actuator arm 111 is movable from the active position shown in the FIG. 4 for arresting the travel of cam 113 which is mounted for rotation about the drive axle 71, to the inactive position permitting free rotation of cam 113 as illustrated by arrow 114. When the actuator arm 111 is in the active position, the extending member or arm 119 of the gripper bar 76 engages the cam 113 to urge its rotation on the axle 71. Thus, movement of the gripper bar 76 toward the document input area from the release area 80 with the actuator arm 111 arresting the travel of the cam 113 urges the arm 119 toward upper portion 121 of the gripper bar 76. The upper portion 121 is secured to the chains and pivotally attached to lower portion 123 of the gripper bar 76. The lower portion 123 is also directly connected to the arm 119 so, as the arm 119 is urged toward the upper portion 121, the lower portion is urged away from the upper portion 121, as illustrated in FIG. 4. Thus, a document secured between the upper and lower portions is released thereby as the gripper bar 76 continue the movement along the path when the cam 113 movement has been arrested by arm 111.

The actuating means for the arm 111 could include a solenoid (not shown) which transmits the illustrated linear motion or even a rotary motion, as illustrated in FIG. 1 by arrow 115, for actuator arm 110 which arrests the movement of cam 112. It should also be understood that the securing of a document in the gripper bar 76 is slightly different than the release of one. That is, after the chain drive 61 is stopped at the input area 51 the gripper bar is opened at area 51 a document is inserted and then the actuator arm is withdrawn so that the cam is released and the spring member 140 and the magnet 142 urge the gripping of a document by the gripper bar. In this embodiment, the magnet 142 is mounted to the upper portion 121 and the lower portion is formed of a ferromagnetic material.

In FIG. 4, an idler roller 130 is provided proximate the upper portion of document catch tray 132 so that documents fed from the imaging station by roller sets 56 and 55 when the gripper bar 76 is halted at the release area 80 tend to form a loop 135 which extends into the tray area as shown in FIG. 4. In this manner, upon release of a document from the gripper bar 76 the documents tend to drop into the tray area from the document release area such. Further, apron 133, as shown in FIG. 4, which is formed of a resilient material, can also be provided to a document released from the gripper bar 76 into the tray 132.

Figure 5:
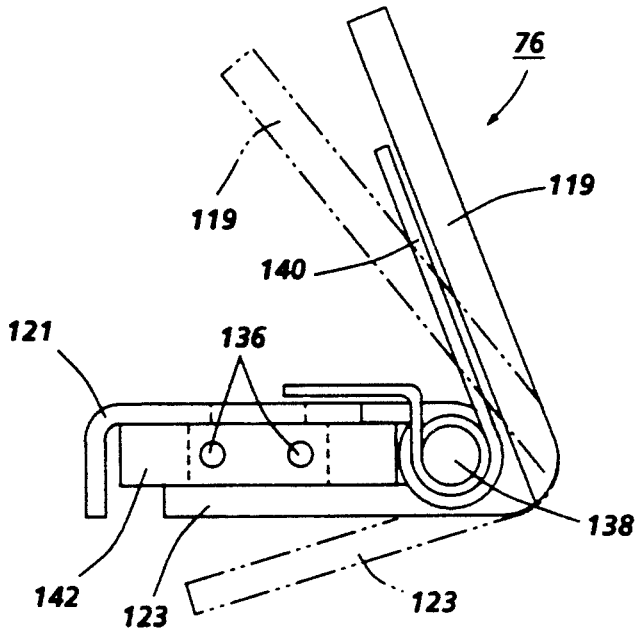
FIG. 5 is an enlarged, elevational view of the gripper bar of the FIG. 1 document handling system.

The gripper bar 76 of FIG. 5 is shown to further illustrate the elements of the preferred embodiment. As previously discussed, the gripper bar 76 includes the arm member 119 which is connected to the lower portion 123 of the gripper bar 76. The arm member 119 and the lower portion 123 are both joined to the upper portion 121 of the gripper bar 76 by an elongated member 138 which extends between intermeshing tubular sections of the upper and lower portions 121 and 123, respectively. Pins 136 extend from the upper portion 121 for attaching the gripper bar 76 to the chains. Spring member 140 is provided to urge the engagement of the lower portion 123 which is formed of a ferromagnetic material and a magnetic member 142 which is secured to the upper portion 121 to thereby secure documents therebetween.

Controller 300 is preferably a microprocessor of the type which is well known in the art or may be a series of elements which provide similar functions. That is, the controller provides clocking and actuating signals to the roller drive motor 57 and to the chain drive motor 74. The control signals to the motors are adapted so that the linear speed of the document through the imaging area is constant and that the faster recirculation speed occurs when the trailing edge of a document has cleared the imaging area 52 and, as in this embodiment of FIG. 1, the nip between rollers 56.

The controller is also interfaced/connected with the instruction and interface panel 310 where machine generated messages are delivered to the operator and operator instructions are transferred to the machine. Thus, as should be clear, in the embodiment of FIG. 1, the control signals for the document handler operation are provided by the machine controller 300. The controller 300 preferably comprises a known programmable microprocessor system, as exemplified by extensive prior art, e.g., U.S. Pat. No. 4,475,156 and its references. Plural but interconnecting microprocessors may be used include at different locations of the document handler and device with which the document handler is associated. It is contemplated that the controller 300 controls all of the machine steps and functions described herein.

As should also be clear, sensors such as sensors 330, 331, and 333 provide informational signals to the controller 300. Specifically, sensor 330 generates signals indicative of the insertion of a document into the gripper bar and the passage of the trailing edge of a document; the sensor 331 generates signals indicative of the passage of the gripper bar, the presence of a document for imaging and passage of the trailing edge of a document; and, likewise, the sensor 333 indicates the passage of the gripper bar, the presence of a document and the passage of the trailing edge of a document. The combination of informational signals from these and other sensors, as well as other informational and comparative signals, presented to the controller 300 allow determination of document length, cessation of imaging and other various functions such as, for example, release of documents, regulation of the drive rates of the roller and chain drives, as well as halting and commencing the chain drive.

It should now be appreciated that the present invention provides a document handler which can be constructed which provides rapid recirculation of documents after processing, but is also independent of the size of documents handled. That is, the length of the endless track can be substantially less than the length of documents handled so that the length of documents handled does not effect the track length. In the embodiment constructed by applicants, by way of example, documents of 60" in length were handled by a track approximately 26" in total length, and it was apparent that documents of substantially greater length could be handled as well. Finally, it should also be appreciated that smaller documents were handled in the same manner without any problems or adaptations.

In recapitulation, a document handler for transporting relatively large documents to processing stations associated with image scanners, printers, copiers and other devices has been disclosed. The document handler has an endless primary path which is of a length relatively independent of the length of documents handled. Documents are transported to and from a processing station along the endless path. A gripper bar is provided to assure entry and exit from the primary path in a registered manner, and a driven chain provides the drive force to move the gripper bar through the processing station at a constant velocity. Drive rollers are also provided to continue to urge documents through the station when the gripper bar is halted at a release area. Additionally, the driven chain is provide with a variable driving speed to drive the gripper bar at a second rate along the path to return to the station.

It is, therefore, apparent that there has been provided in accordance with the present invention, a document handling device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method of recirculating large documents through a processing station along an endless document path, comprising the steps of:

securing a leading of a document in a gripper bar;

transporting the gripper bar in a predetermined direction through an image processing station at a predetermined imaging speed so that the lead edge of a document secured in the gripper bar passes through the image processing station;

engaging documents passing through the image processing station in a nip between opposed roller sets disposed on opposite sides of the station;

actuating the roller sets to urge the document through the image processing station at the predetermined imaging speed;

stopping the gripper bar at a document release station;

sensing the passage of the trailing edge of the document through the imaging area; and transporting the gripper bar in the predetermined direction toward the image processing station at a second recirculating speed greater than the imaging speed.

2. The method of claim 1, further comprising the steps of:

sensing the number of images made of a document secured in the gripper bar;

comparing the number of images made with a preselected number; and actuating a release mechanism to release a document secured in the gripper bar at the release station when said number of images equals the preselected number.

3. The method of claim 1, further comprising the steps of:

opening the gripper bar to accept documents at a document input station;

urging the leading edge of a document into an engageable position with said gripper bar; and closing said gripper bar to thereby and releasably secure the document.

4. the method of claim 3, further comprising the steps of:

sensing the number of images made of a document secured in the gripper bar;

comparing the number of images made with a preselected number; and actuating a release mechanism to release a document secured in the gripper bar at the release station.

5. A document transport system for recirculating large documents along an endless document path through an imaging station, comprising:

a gripper for selectively and releasably securing leading edges of large documents;

a gripper drive system for moving the gripper in a predetermined recirculation direction to the imaging station and then so that the lead edge of the document passes through the imaging station secured in said gripper at a predetermined imaging speed, said gripper drive system intermittently halting said gripper along the endless document path at a first position downstream from the imaging station and at a second position upstream from the imaging station;

at least one roller set disposed adjacent to the image station, said roller set forming a nip for engaging a document passing through the imaging station;

a roller system for driving said roller set to feed the document through the image station at the predetermined imaging speed; and a sensor for sensing the passage of the trailing edge of the document through the imaging station and controlling said gripper drive system to move said gripper in the predetermined recirculation direction towards the imaging station at a second recirculating speed which is substantially greater than the imaging speed.

6. The document transport system of claim 5, further comprising:

a gripper release system for selectively releasing documents from said gripper proximate said first position downstream from the imaging station; and a sheet gripper actuator for selectively securing the leading edge of a document in said gripper proximate said second position upstream from the imaging station.

7. The document transport system of claim 6, wherein said gripper drive system comprises a driven belt-like member to which said gripper bar is secured.

8. The document transport system of claim 5, wherein said roller set is resiliently mounted to permit passage of said gripper through the nip of said roller set and to maintain positive engagement of a document disposed in the nip of said roller set.

9. The document transport system of claim 8, further comprising a release system for selectively releasing documents from said gripper proximate said first position after the trailing edge of such document has passed through said imaging station.

* * * * *